US005221511A

United States Patent [19]

Fukase et al.

[11] Patent Number: 5,221,511

[45] Date of Patent: Jun. 22, 1993

[54] STRIP CASTING

[75] Inventors: Hisahiko Fukase, Wollongong; Walter Blejde, Balgownie; William J. Folder, Wollongong; Keith F. Pitchford, Albion Park; Joseph G. Herbertson, Newcastle, all of Australia

[73] Assignees: Ishikawajima-Harima Heavy Industries, Co., Ltd., Tokyo, Japan; John Lysaght (Aus) Ltd., Sydney, Australia

[21] Appl. No.: 791,667

[22] Filed: Nov. 14, 1991

[30] Foreign Application Priority Data

Nov. 14, 1990 [AU] Australia ..... PK3355
Mar. 1, 1991 [AU] Australia ..... PK4876

[51] Int. Cl.[5] ..... B22D 41/50

[52] U.S. Cl. ..... 266/45; 266/230; 222/594; 222/597

[58] Field of Search ..... 266/230, 236, 45; 222/597, 592, 594, 600

[56] References Cited

U.S. PATENT DOCUMENTS

| | | | |
|---|---|---|---|
| 1,338,001 | 4/1920 | Cordes | 222/597 |
| 1,920,300 | 8/1933 | Gesel et al. | 222/597 |
| 4,828,012 | 5/1989 | Honeycutt, III et al. | 266/236 |
| 4,865,115 | 9/1989 | Hirata et al. | 222/592 |

*Primary Examiner*—Scott Kastler
*Attorney, Agent, or Firm*—Nikaido, Marmelstein, Murray & Oram

[57] ABSTRACT

A method and apparatus for casting metal strip in which molten metal is introduced between a pair of parallel casting rollers via a metal delivery nozzle disposed above the nip between the rollers, wherein the delivery nozzle comprises an elongate trough to receive molten metal, a nozzle outlet slot extending longitudinally along the bottom of the trough, a baffle structure extending above the slot, and a pair of flow passage means spaced apart laterally of the trough, one to each side of the outlet slot and each providing for flow of molten metal from the trough interior above the baffle structure into the trough interior below the baffle structure.

30 Claims, 6 Drawing Sheets

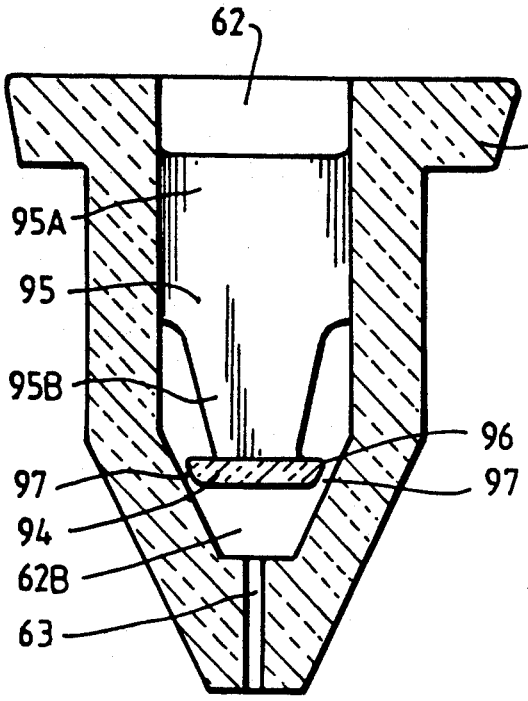
FIG. 8.
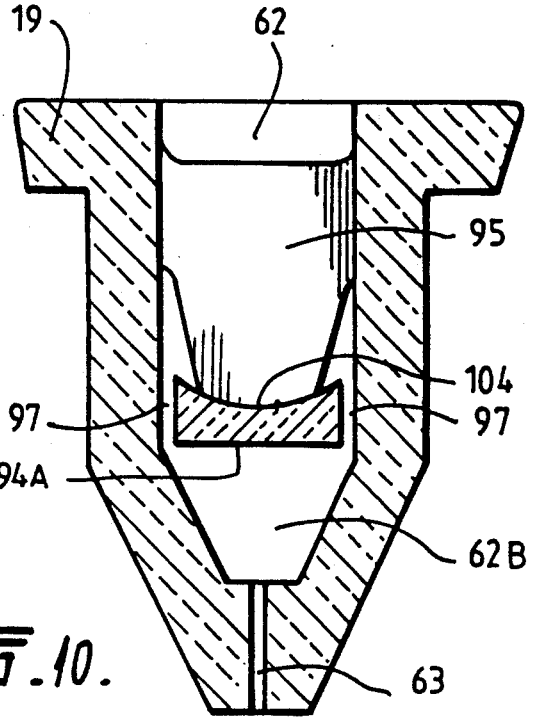
FIG. 10.
FIG. 9.
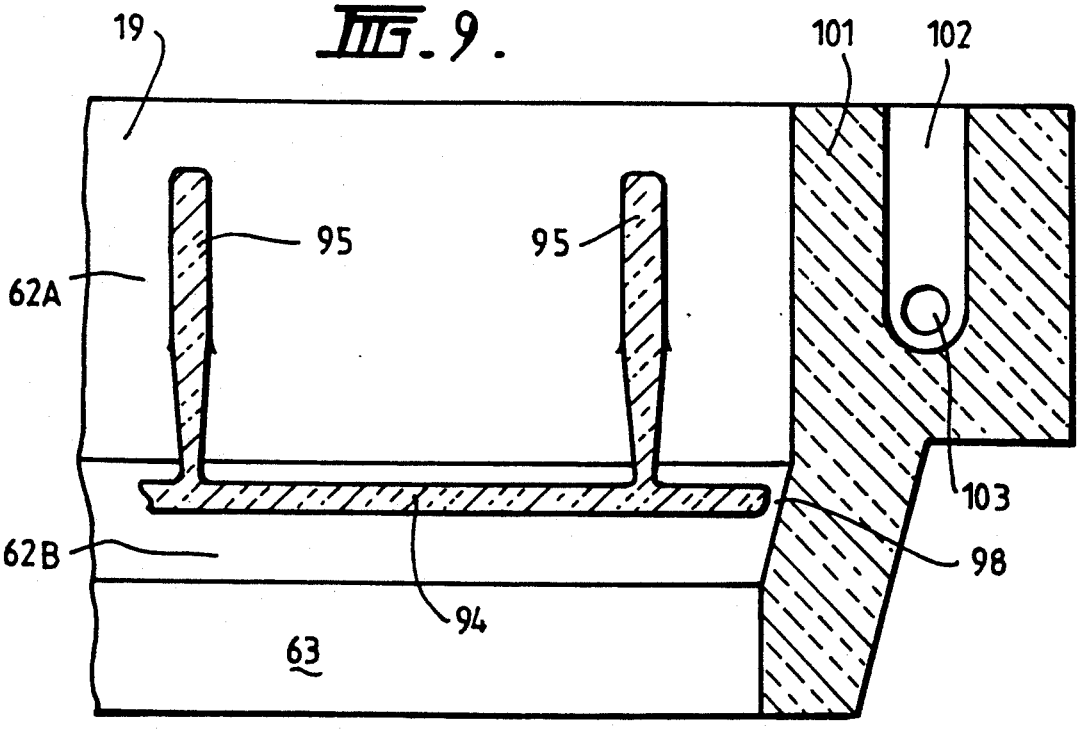

STRIP CASTING

TECHNICAL FIELD

This invention relates to the casting of metal strip. It has particular but not exclusive application to the casting of ferrous metal strip.

It is known to cast non-ferrous metals such as aluminium by continuous casting in a twin roll caster. Hot metal is introduced between a pair of contra-rotated horizontal casting rollers which are cooled so that metal shells solidify on the moving roller surfaces and are brought together at the nip between them to produce a solidified strip product at the outlet from the roller nip. The hot metal may be introduced into the nip between the rollers via a tundish and a metal delivery nozzle located beneath the tundish so as to receive a flow of metal from the tundish and to direct it into the nip between the rollers.

Although twin roll casting has been applied with some success to non-ferrous metals which solidify rapidly on cooling, there have been problems in applying the technique to the casting of ferrous metals. One particular problem has been the achievement of even cooling and solidification to allow continuous casting to proceed. This problem is addressed by the invention disclosed in our co-pending Australian Patent Application No. PJ9458. It has also been found that when casting ferrous metal strip the importance of obtaining an even flow distribution across the width of the nip is particularly critical and defects can occur due to minor flow fluctuations. The present invention addresses this problem and provides an apparatus and technique whereby a very even flow distribution can be achieved. Although the invention has been developed to overcome a problem which is particularly critical in the casting of ferrous strip, it may also be applied to the casting of non-ferrous metals, for example aluminium.

DISCLOSURE OF THE INVENTION

According to the invention there is provided a casting metal strip of the kind in which molten metal is introduced between a pair of parallel casting rollers via a metal delivery nozzle disposed above the nip between the rollers, wherein the delivery nozzle comprises an elongate trough to receive molten metal, a nozzle outlet slot extending longitudinally along the bottom of the trough, a baffle structure extending across the trough above the slot outlet, and a pair of flow passage means spaced apart laterally of the trough one to each side of the outlet slot and each providing for flow of molten metal from the trough interior above the baffle structure into the trough interior below the baffle structure.

Preferably, a pool of the molten metal is formed above the nip between the rollers and the nozzle outlet slot extends beneath the surface of that pool.

Preferably too, the molten metal is supplied to the delivery nozzle so as to form a head of molten metal in the trough of the delivery nozzle to a height above the level of the surface of said pool.

The invention also provides apparatus for casting metal strip, comprising a pair of parallel casting rollers forming a nip between them and a metal delivery nozzle for delivering molten metal into the nip between the casting rollers, wherein the metal delivery nozzle comprises an elongate trough to receive molten metal, a nozzle outlet slot extending longitudinally along the bottom of the trough, a baffle structure extending across the trough above the slot outlet, and a pair of flow passage means spaced apart laterally of the trough one to each side of the outlet slot and each providing for flow of molten metal from the trough interior above the baffle structure into the trough interior below the baffle structure.

Said pair of flow passage means may comprise two arrays of flow passages for flow of molten metal from the trough interior above the baffle structure into the interior below the baffle structure, each array comprising a plurality of passages spaced longitudinally of the trough and the arrays being spaced apart laterally of the trough one to each side of the outlet slot. The two arrays may be generally linear arrays disposed parallel to one another and the passages of one array may be staggered with respect to the passages of the other array longitudinally of the trough.

Alternatively, said pair of flow passage means may comprise a pair of elongate slot passages defined by clearance between the baffle structure and side walls of the trough. Accordingly, the invention specifically also provides apparatus for casting metal strip, comprising a pair of parallel casting rollers forming a nip between them and a metal delivery nozzle for delivering molten metal into the nip between the casting rollers, wherein the metal delivery nozzle comprises an elongate trough to receive molten metal, a nozzle outlet slot extending longitudinally along the bottom of the trough, a baffle structure extending across the trough above the slot outlet, and a pair of elongate slot passages defined by clearances between the baffle structure and side walls of the trough for flow of molten metal from the trough interior above the baffle structure into the trough interior below the baffle structure. In this arrangement, each slot passage may extend substantially throughout the length of the trough. The baffle structure may be supported in the trough by support means extending from an upper part of the trough and there may be clearance between the baffle structure and the trough walls about its entire perimeter.

BRIEF DESCRIPTION OF THE DRAWINGS

In order that the invention may be more fully explained, three particular embodiments will be described in detail with reference to the accompanying drawings in which:

FIG. 8 is a transverse cross-section through the nozzle and baffle structure illustrated in FIGS. 6 and 7;

FIG. 9 is a longitudinal cross-section through the nozzle and baffle structure illustrated in FIGS. 6 to 8; and FIG. 10 is a transverse cross-section through a further modified nozzle and baffle structure constructed in accordance with the invention.

BEST MODE OF CARRYING OUT THE INVENTION

Figure 1:
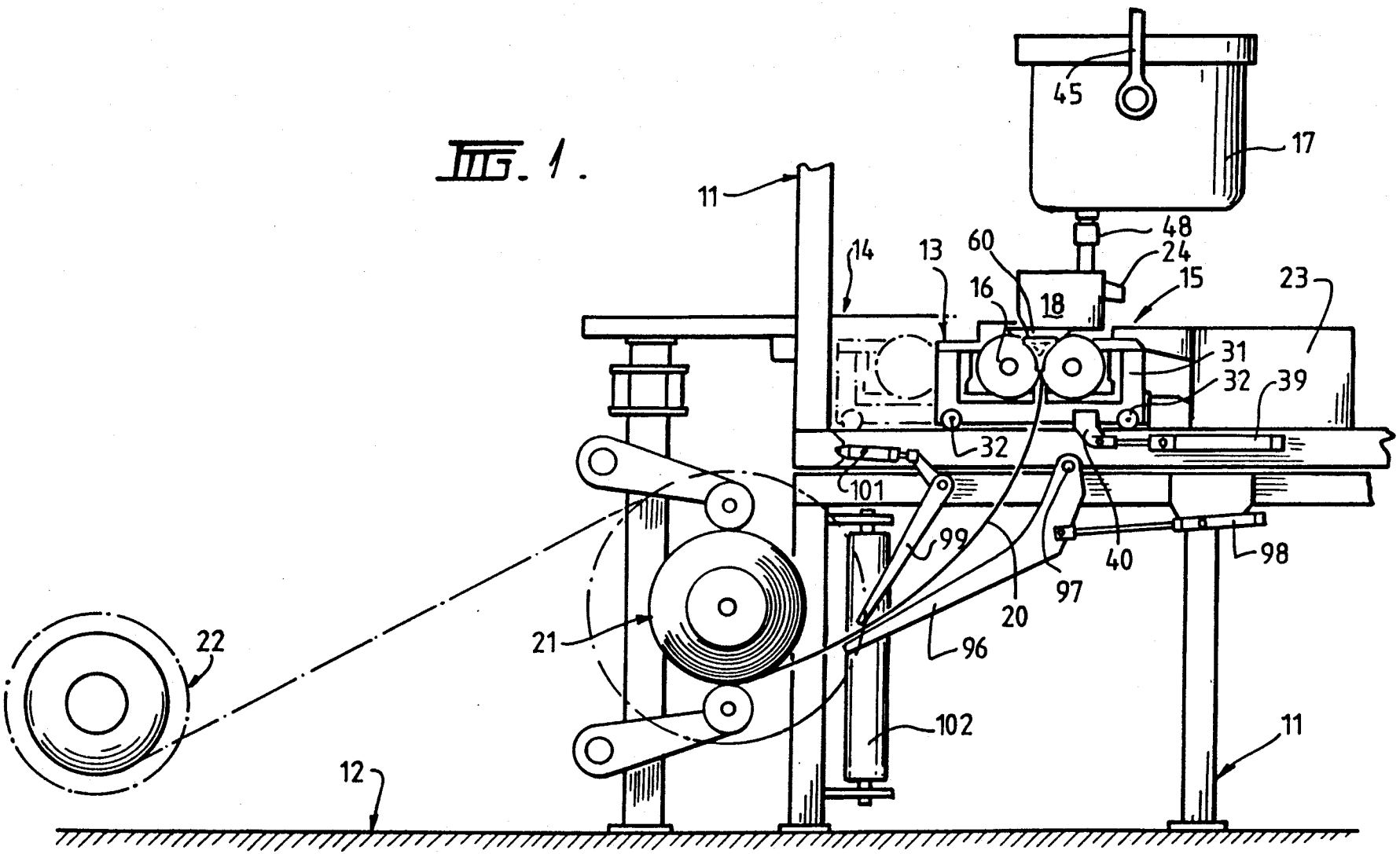
FIG. 1 illustrates a continuous strip caster incorporating apparatus constructed and operating in accordance with the present invention.
Figure 2:
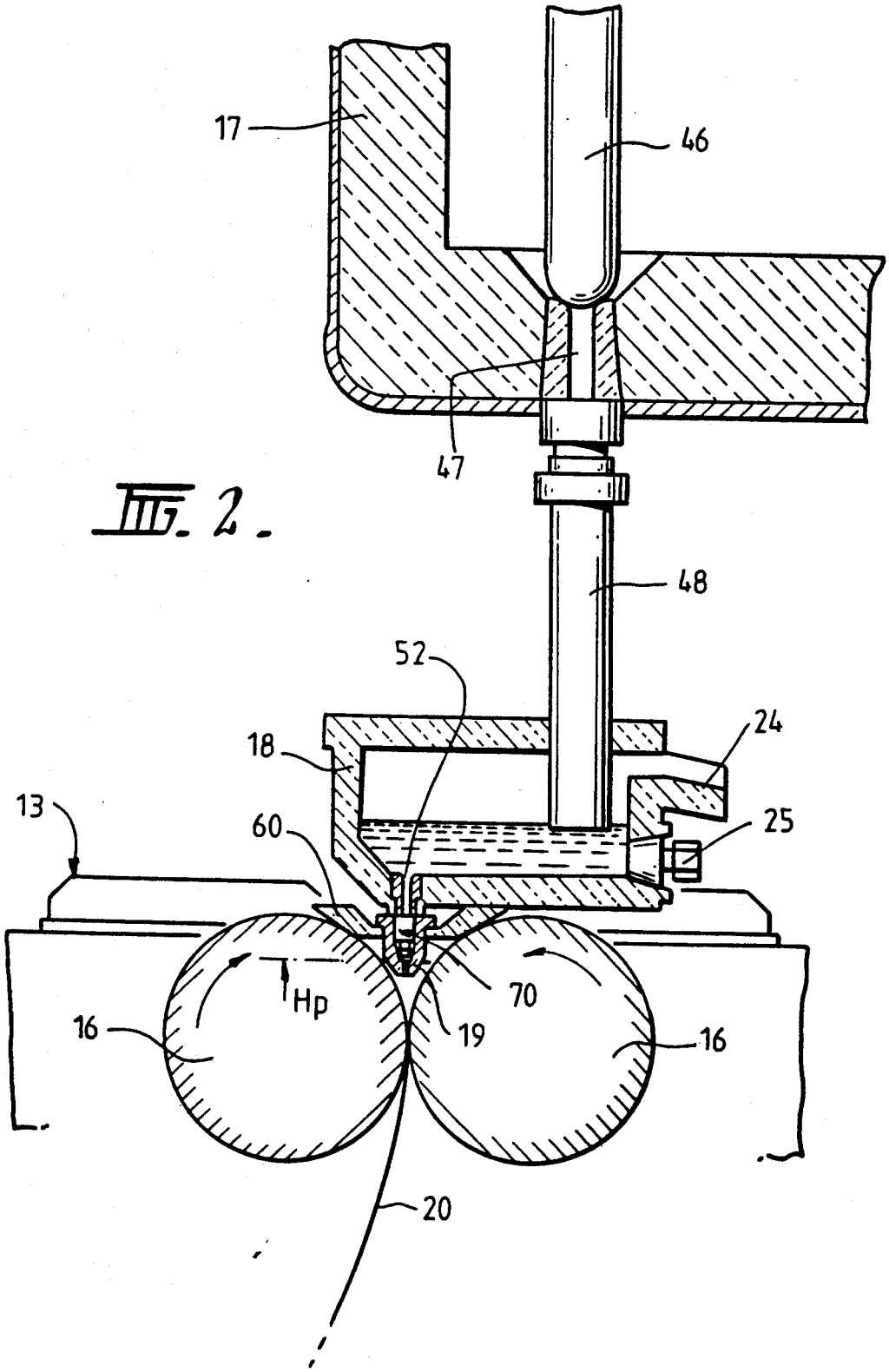
FIG. 2 is a vertical cross-section through important components of the caster illustrated in FIG. 1 including a metal delivery nozzle fitted with a baffle structure in accordance with the invention.
Figure 3:
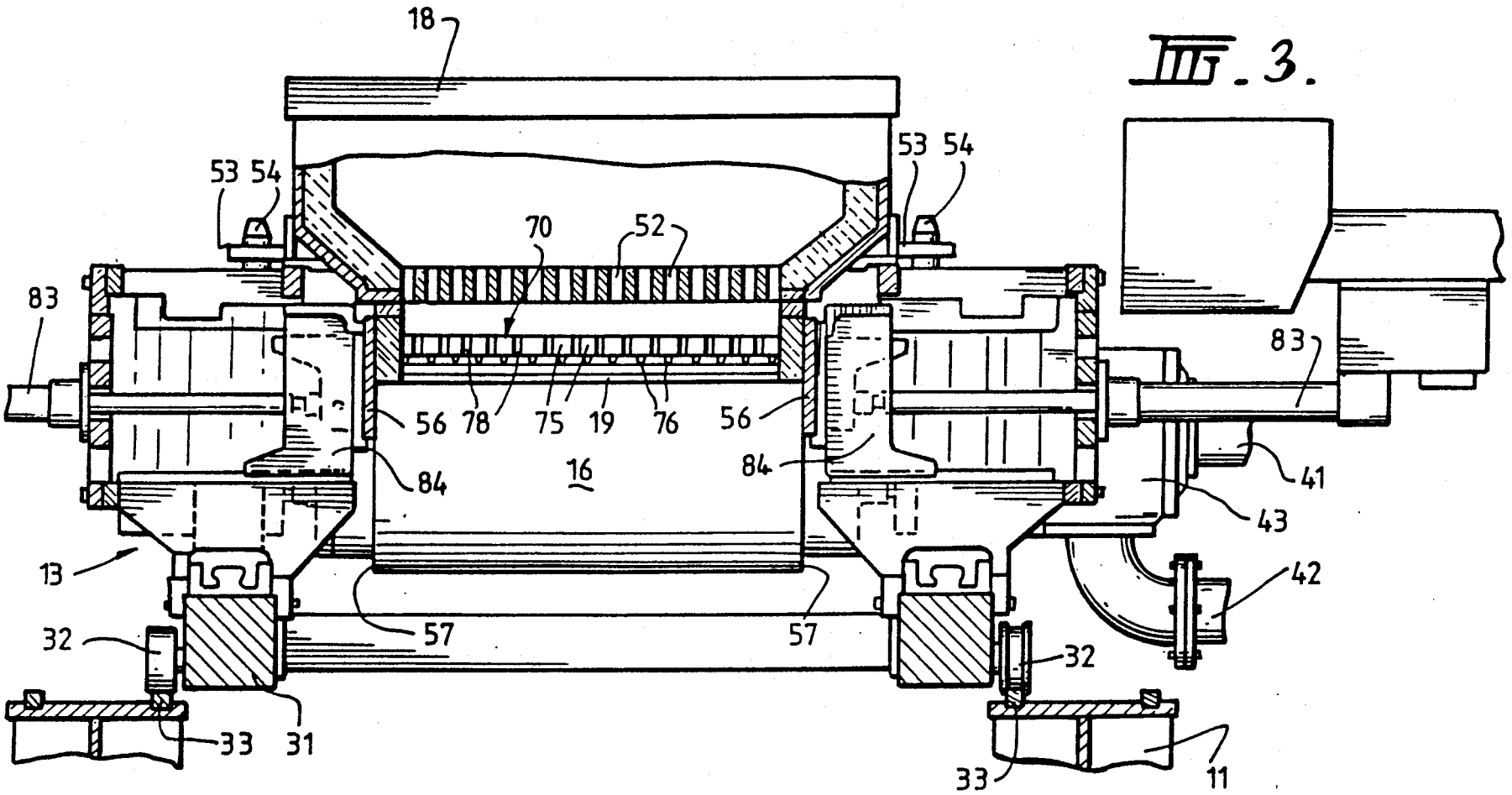
FIG. 3 is a further vertical cross-section through important components of the caster taken transverse to the section of FIG. 2.
Figure 4:
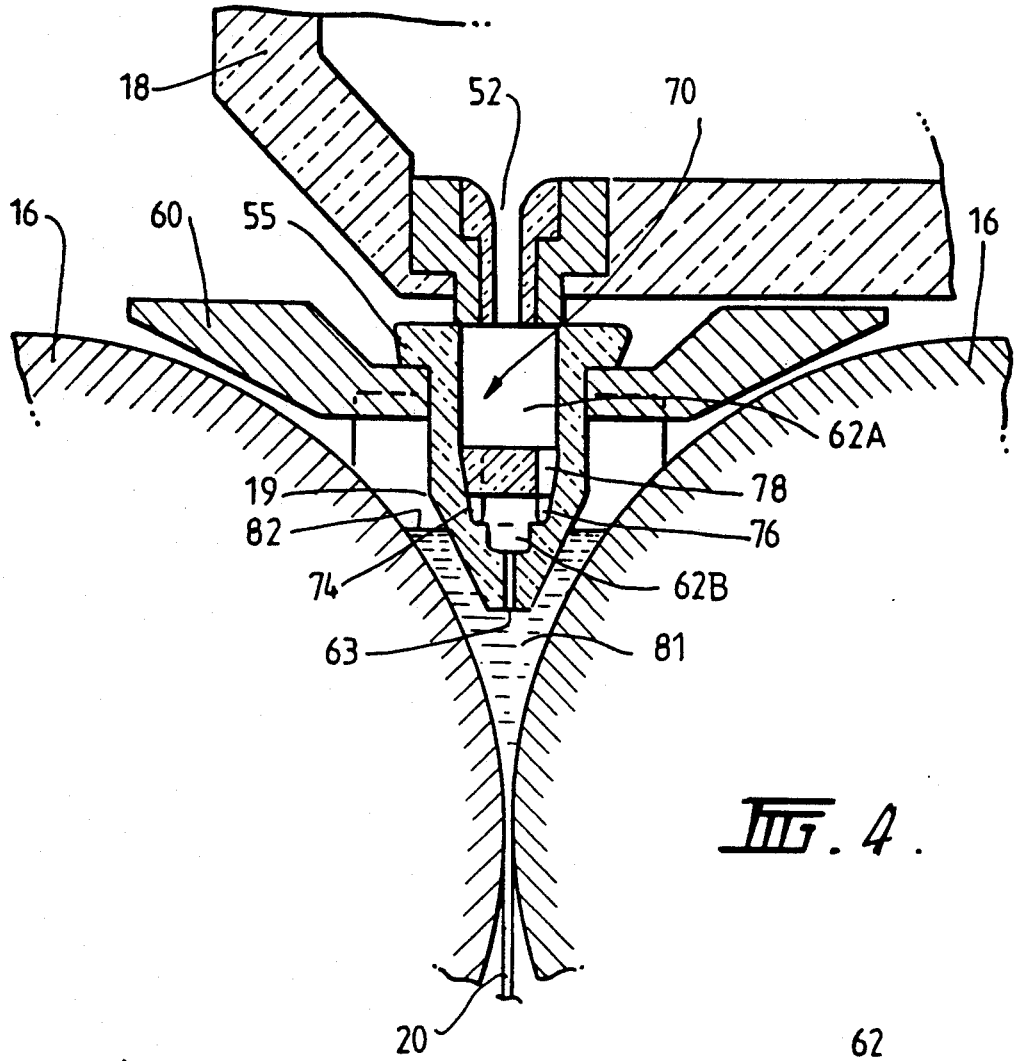
FIG. 4 is an enlargement of part of FIG. 2.
Figure 5:
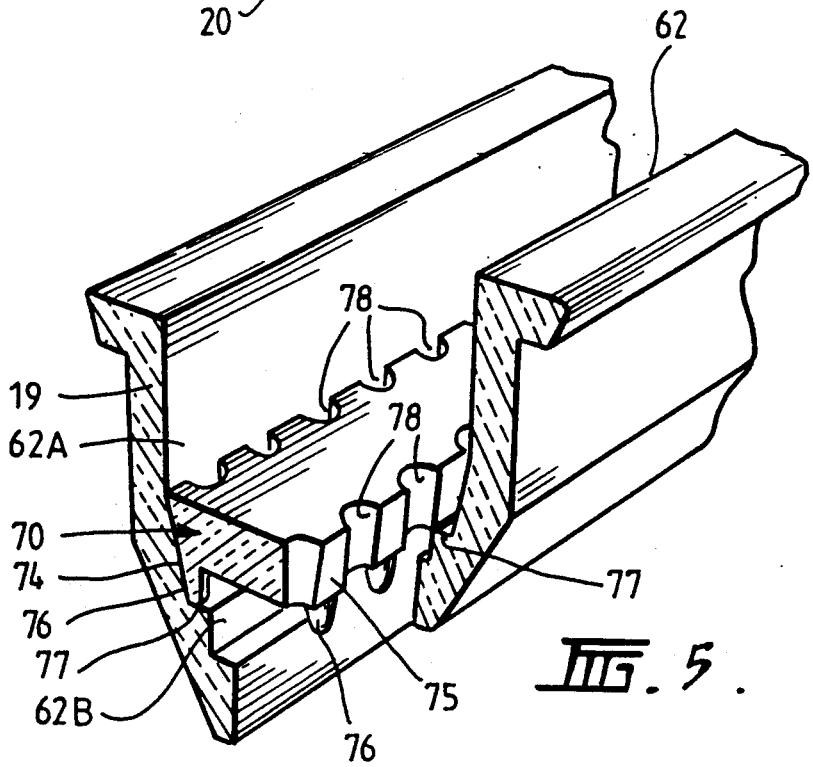
FIG. 5 is a broken away perspective view of a part of the delivery nozzle.

The caster illustrated in FIGS. 1 to 5 comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles in which the rollers 16 are rotatably mounted. Carriage 13 is movable along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roller carriage frame 31 and provided with apertures to receive indexing pegs 54 on the carriage frame so as accurately to locate the tundish.

Delivery nozzle 19 is formed as an elongate body made of a refractory material such as alumina graphite. Its lower part is tapered so as to converge inwardly and downwardly so that it can project into the nip between casting rollers 16. A mounting bracket 60 is provided to support the nozzle on the roller carriage frame and the upper part of the nozzle is formed with outwardly projecting side flanges 55 which locate on the mounting bracket.

Delivery nozzle 19 has an internal vertically extending trough 62 to receive liquid flowing downwardly through the openings 52 of the tundish. Trough 62 converges toward its lower end part which serves as an outlet flow passage for flow of metal into the nip between the rollers 16. More specifically, the lower part of trough 62 terminates at an elongate outlet slot 63 at the bottom end of the delivery nozzle which slot extends longitudinally of the nip between the casting rollers.

In accordance with the present invention, the trough is divided into upper and lower parts 62A, 62B by a baffle structure denoted generally as 70.

In the embodiment illustrated in FIGS. 1 to 5, baffle structure 70 is in the form of a separately formed baffle block which fits snugly within the trough 62. Specifically, the side walls of the trough have downwardly and inwardly tapering wall portions 74 and the baffle block 70 has similarly tapered side walls 75 to fit snugly against the tapered wall portions 74. The bottom of the baffle block 70 is also provided with downwardly projecting bosses or feet 76 to rest on inwardly projecting shoulders 77 formed in the side walls of the trough in the trough part 62B to ensure that the baffle block sits in place some distance above the floor of the trough. Baffle block 70 may also be formed of a refractory material such as alumina graphite.

The side walls 75 of baffle block 70 are formed with downwardly extending longitudinally spaced notches or grooves and when the block is fitted within the nozzle, these notches form two arrays of flow passages 78 for flow of molten metal from the upper part 62A into the lower part 62B of the trough around the baffle block. More specifically, the passages 78 are arranged in two generally linear arrays spaced apart laterally of the trough one to each side of the outlet slot 63. The passages of one array are staggered with respect to the passages of the other array longitudinally of the trough by appropriate longitudinal staggering of the respective grooves in the side faces 75 of the baffle block 70.

In operation of the apparatus illustrated in FIGS. 1 to 5, molten metal from the tundish falls into the trough 62 defined by delivery nozzle 19 and impinges on the upper face of baffle block 70 to absorb energy from the falling stream of metal. The molten metal flows laterally outwardly on the upper face of the baffle block and then down through the restricted passages 78 at each side of the baffle block into the lower part 62B of the trough. The downward streams of metal from passage 78 are directed onto the upwardly facing shoulders 77 formed in the lower part of the trough to further absorb kinetic energy. Metal tends to flow in the lower part 62B of the trough laterally in longitudinally staggered streams from the respective sides of the trough to form a relatively static pool of metal in the floor of the trough from which the metal flows in a steady relatively slow stream through the outlet slot 63. Thus, the nozzle fitted with the baffle is very effective to convert a high velocity relatively uneven stream falling from the tundish to a much slower constant velocity stream over the full width of the outlet slot 63.

During a casting run molten metal delivered from the delivery nozzle forms a pool 81 above the nip between the rollers, this pool being confined at the ends of the rollers by a pair of side closure plates 56 which are held against stepped ends 57 of the rollers by actuation of a pair of hydraulic cylinder units 83 fitted with closure plate holders 84. The upper surface 82 of pool 81, generally referred to as the "meniscus level" rises above the lower end of the delivery nozzle. Accordingly, the lower end of the delivery nozzle is immersed within this pool and the nozzle outlet passage extends below the surface of the pool or meniscus level. The flow of metal is also such as to produce a head or pool of molten metal within the lower part 62B of the delivery nozzle to a height above the meniscus level 82. The pool or head of metal in the lower part of the trough may extend to an upper surface spaced below the underface of the baffle block 70. Alternatively, it may extend up into the arrays of flow passages 78 and may even extend above the baffle block so that the falling metal discharges in to the pool above the baffle.

In a typical ferrous metal caster constructed in accordance with the invention, the width of the slot outlet from the nozzle may be in the range 1 mm to 3 mm, for example, around 1.5 mm. The baffle block may be approximately 50 mm wide and 15 mm deep and the side grooves in the baffle block may typically be formed to about 15 mm radius and arranged at about 15 mm longitudinal spacing. During a casting run the head of metal formed in the bottom part of the delivery nozzle trough may typically be about 20 mm above the meniscus level 82.

Figure 6:
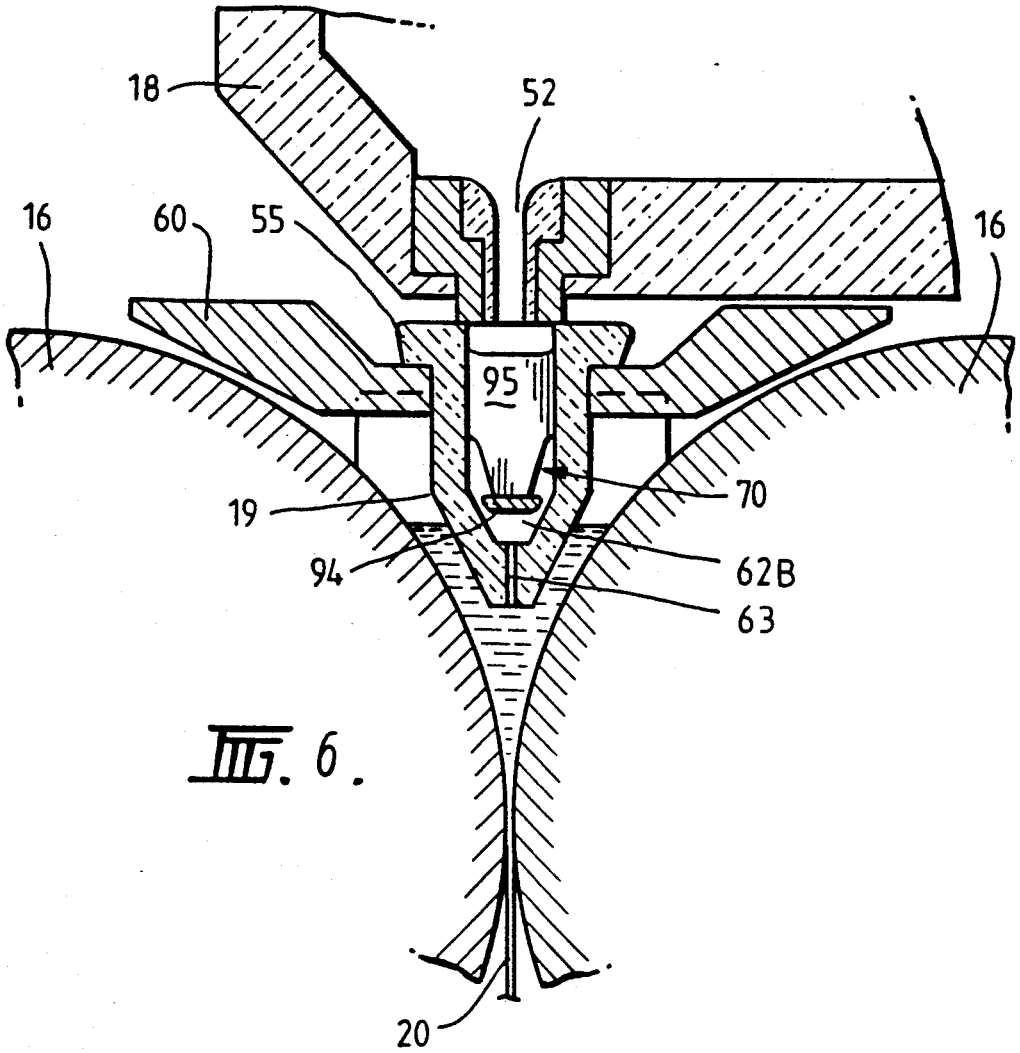
FIG. 6 is a view similar to that of FIG. 4 but shows the nozzle fitted with a modified form of baffle structure also in accordance with the present invention.
Figure 7:
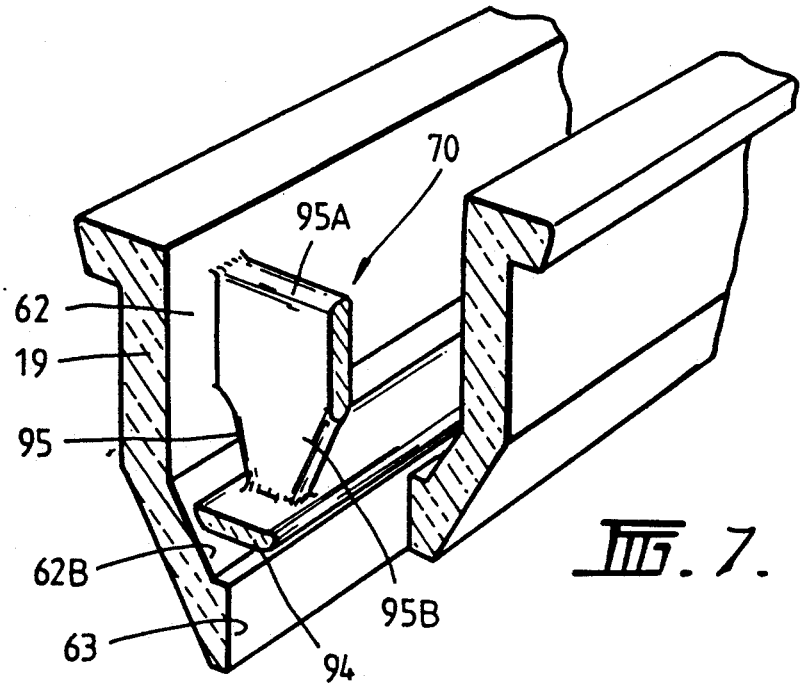
FIG. 7 is a broken away perspective view of part of the delivery nozzle and baffle structure shown in FIG. 6.

In a modified construction illustrated in FIGS. 6 to 9 the baffle structure 70 is in the form of an elongate strip or plate 94 suspended from an upper part of the trough by a pair of hanger supports 95. The hanger supports may comprise upper vertical plate portions 95A extending across an upper part of the trough and downwardly convergent suspension leaf portions 95B which are narrower at their bottom ends than the baffle plate 94 so that the baffle plate projects laterally outwardly beyond them.

The baffle plate 94 is supported by structures 95 so that there is clearance between the baffle plate and the side walls of the trough around the entire perimeter of the baffle plate. Specifically, there is clearance along the two longitudinal side edges 96 of the baffle plate to define elongate slot passages 97 extending along the nozzle trough substantially throughout its length and there are clearance spaces 98 at each end of the baffle plate. The elongate slot passages 97 and the end clearance passages 98 provide for flow of molten metal from the trough interior above the baffle structure into the trough interior below the baffle structure. The side passages 97 are spaced apart laterally of the trough one to each side of the outlet slot 63. The side edges 96 of the baffle plate are bevelled so as to converge downwardly to generally match the downward convergence of the side walls of the nozzle so that the side passages 97 have generally parallel or slightly downwardly divergent side walls.

In a further modification, each end of the metal flow delivery nozzle has a thickened end wall portion 101 provided with a metal flow passage 102 which is separate from the interior of the trough and which branches into a pair of downwardly directed metal flow outlets 103 to direct separate streams of molten metal against the side closure plates 56 confining the metal pool above the nip between the rollers, as explained below.

In operation of the apparatus as illustrated in FIGS. 6 to 9, molten metal from the tundish falls into trough 62 defined by delivery nozzle 19 and impinges on the upper face of baffle plate 94 to absorb energy from the falling stream of metal. The molten metal flows laterally outwardly on the upper face of the baffle plate 94 and then down through the elongate slot passages 97 at each side of the baffle plate into the lower part 62B of the trough. Metal also can flow downwardly through the clearance spaces 98 at the ends of the baffle plate into the lower part of the trough. The flow of metal through these restricted passages forms a relatively static pool of metal in the floor of the trough from which the metal flows in a steady relatively slow stream through the outlet slot 63. Thus, the nozzle fitted with the baffle is very effective to convert a high velocity relatively uneven stream falling from the tundish to a much slower constant velocity stream over the full width of the outlet slot 63. It has been found that the provision of the continuous slot passages 77 extending substantially throughout the length of the trough results in a particularly even flow and avoids the possibility of marking in the final strip product associated with spaced individual flow passages.

As in the operation of the previous embodiment, molten metal is delivered from the delivery nozzle to form pool 81 above the nip between the rollers, this pool being confined at the ends of the rollers by the closure plates 56. Metal from the tundish is also delivered to flow passages 102 and the outlets 103 from these passages deliver streams of hot molten metal over the side closure plates to prevent premature solidification of metal in these regions. The upper surface of pool 81, generally referred to as the "meniscus level" rises above the lower end of the delivery nozzle. Accordingly, the lower end of the delivery nozzle is immersed within this pool and the nozzle outlet passage extends below the surface of the pool or meniscus level. The flow of metal is also such as to produce a head or pool of molten metal within the lower part 62B of the delivery nozzle to a height above the meniscus level. The pool or head of metal in the lower part of the trough may extend to an upper surface spaced below the underface of the baffle plate 94. Alternatively, it may extend higher and even above the baffle plate so that the falling metal discharges into the pool above the baffle plate.

As in the previous embodiment of the invention, the width of the slot outlet from the nozzle may be in the range 1 mm to 3 mm, for example around 1.5 mm. The baffle plate may be approximately 30 mm wide and 10 mm thick. The side flow passages 27 may typically be about 5 mm wide and extend throughout a trough length of about 700 mm. During a casting run the head of metal formed in the bottom part of the delivery nozzle trough may typically be about 30 mm above the meniscus level.

FIG. 10 illustrates a further modification which is very similar to that shown in FIGS. 6 to 9 and in which like parts have been identified by the same reference numerals. The modification involves the use of a modified baffle plate 94A which is thickened at its outer edges so as to form lengthened side passages 97 and has a curved upper face to define a pronounced upwardly facing channel 104 extending longitudinally of the baffle plate. In operation of this embodiment of the invention, molten metal accumulates in channel 104 so that the falling streams of molten metal from the tundish fall into a pool formed within the channel. This promotes a smooth absorption of kinetic energy with minimum splashing and the fact that the metal must flow upwardly and outwardly to reach the side passages 97 further promotes a smooth progressive reduction of kinetic energy and a smooth flow of metal through the side passages 97.

The illustrated embodiments of the invention have been advanced by way of example only and many variations are possible. For example the first embodiment could be varied by forming the baffle structure integrally with the trough structure. More specifically, the nozzle may have a trough structure. More specifically, the nozzle may have a trough divided into upper and lower parts by a baffle structure which is moulded integrally with the trough structure in a suitable refractory material such as alumina graphite. In the moulding process, two arrays of flow passages are formed for flow of molten metal from the upper part into the lower part of the trough. As before, each array of flow passages may comprise a plurality of passages spaced longitudinally of the trough and the arrays may be spaced apart laterally of the trough one to each side of the outlet sot. The flow passages may be of similar cross-section to the passages 78 of the illustrated apparatus. Alternatively, they may be of generally elongate rectangular cross-section aligned longitudinally of the trough.

The illustrated forms of apparatus have enabled successful casting of ferrous strip but can also be applied to casting of non-ferrous metals for example, aluminium. It is accordingly to be understood that the invention is in no way limited to details of the above described apparatus and method and that many variations will fall within the scope of the appended claims.

We claim:

1. A method of casting metal strip comprising:

introducing molten metal between a pair of parallel casting rollers with a nip therebetween by downwardly flowing said molten metal through a metal delivery nozzle disposed above the nip between the roller wherein the delivery nozzle comprises an elongate trough to receive molten metal and, extending longitudinally of said nip, a nozzle outlet slot extending longitudinally along the bottom of the trough spaced above said nip, a baffle structure, comprising two lateral baffle means extending sidewise of the centerline of said outlet opening, and extending within and across the trough above the outlet slot, interrupting the downward flow of said molten metal through said trough to said outlet slot, diverting said downward flow of molten metal into a lateral direction through a pair of flow passage means spaced apart laterally within the trough and above the outlet slot, one to each side of the centerline of the outlet slot, each of said baffle means causing molten metal to flow through said passage means from the trough interior above the baffle structure into the trough interior below the baffle structure, after passing said lateral streams through said baffle means, causing said laterally directed molten metal to flow downwardly and to converge below said baffle structure and above said outlet slot, and passing said molten metal through said outlet slot downwardly as a continuous, single stream along the length of said outlet slot toward said nip.

2. A method as claimed in claim 1, including positioning said nozzle outlet slot above the nip between the rollers and extending beneath the surface of a pool of molten metal in said nip.

3. A method as claimed in claim 2, including supplying molten metal to the delivery nozzle in an amount and at a rate sufficient to form a head of molten metal in the trough of the delivery nozzle to a height above the level of the surface of said pool.

4. A method as claimed in claim 1, including supplying molten metal to the delivery nozzle as a series of falling streams spaced along the trough.

5. A method as claimed in claim 1 including passing molten metal laterally through two arrays of flow passages at the lateral outer margins of said baffle means, comprising a plurality of passages spaced longitudinally of the trough and the arrays being spaced laterally of the trough one to each side of the outlet slot, from the trough interior above the baffle structure into the trough interior below the baffle structure.

6. A method as claimed in claim 1 including passing separate streams of molten metal from the interior of said trough above said baffle structure through a pair of substantially parallel elongate slot passages defined by the clearance between the baffle structure and each of the side walls of the trough respectively, along substantially the entire length of said trough, and bringing said separate streams together into a continuous downward flow of molten metal below said baffle structure.

7. Apparatus for casting metal strip, comprising a pair of parallel casting rollers forming a nip between them and a metal delivery nozzle, disposed above said nip, for delivering molten metal downwardly into a casting pool above said nip throughout the length of said nip, wherein the metal delivery nozzle comprises an elongate trough extended longitudinally of said nip adapted to receive molten metal, a nozzle outlet slot extending longitudinally along the bottom of the trough above said nip, a baffle structure extending across the trough above the outlet slot and a pair of flow passage means spaced apart laterally of the trough one each side of the outlet slot adapted to provide for downward flow of molten metal from the trough interior above the baffle structure into the trough interior below the baffle structure substantially throughout the length of the trough.

8. Apparatus as claimed in claim 7, wherein said pair of flow passage means comprises two arrays of flow passages, each array comprising a plurality of passage spaced longitudinally of the trough and each array being spaced apart laterally of the trough one to each side of the outlet slot.

9. Apparatus as claimed in claim 8, wherein the two arrays are generally linear arrays disposed parallel to one another.

10. Apparatus as claimed in claim 8, wherein the two arrays are generally linear arrays disposed parallel to one another and the passages of one array are staggered with respect to the passages of the other array longitudinally of the trough.

11. Apparatus a claimed in claim 8, wherein the baffle structure comprises a baffle block fitted into the trough and the passages are formed by notches or grooves in the side faces of the block to define the passages between the block and side walls of the trough.

12. Apparatus as claimed in claim 7, wherein said pair of flow passage means comprises a pair of elongate slot passages defined by clearance between the baffle structure and the side walls of the trough.

13. Apparatus as claimed in claim 12, wherein each slot passage extends substantially throughout the length of the trough.

14. Apparatus as claimed in claim 12, wherein the baffle structure is supported in the trough by support means extending from an upper part of the trough.

15. Apparatus as claimed in claim 14, wherein the support means is formed integrally with the baffle structure and the walls of the trough.

16. Apparatus as claimed in claim 12, wherein there is clearance between the baffle structure and the trough walls about its entire perimeter.

17. Apparatus as claimed in claim 12, wherein the baffle structure defines an upwardly facing channel extending along the trough to receive the molten metal and to cause the molten metal to flow upwardly and outwardly of the trough on top of the baffle structure in passing to the passage means.

18. Apparatus as claimed claim 7, further comprising a tundish for supply of molten metal to the delivery nozzle which is provided with a series of flow outlets to supply molten metal to the delivery nozzle in a series of falling streams spaced longitudinally along the trough.

19. A metal delivery nozzle for delivering molten metal to a nip between a pair of casting rollers, which delivery nozzle comprises an elongate trough adapted to receive molten metal, a nozzle outlet slot extending longitudinally along the bottom of the trough, a baffle structure extending across the trough above the outlet slot, a pair of flow passage means spaced apart laterally of the trough one to each side of the outlet slot and each adapted to permit the flow of molten metal from the trough interior above the baffle structure into the trough interior below the baffle structure, and means to combine said molten metal flow through said flow passage means into a single flow issuing form said outlet slot.

20. A metal delivery nozzle as claimed in claim 19, wherein said pair of flow passage means comprises two arrays of flow passages flow of molten metal from the trough interior above the baffle structure into the trough interior below the baffle, each array comprising a plurality of passages spaced longitudinally of the trough each array being spaced apart laterally of the trough one to each side of the outlet slot.

21. A metal delivery nozzle as claimed in claim 20, wherein the two arrays are generally linear arrays disposed parallel to one another.

22. A metal delivery nozzle as claimed in claim 20, wherein the two arrays are generally linear arrays disposed parallel to one another and the passages of one array are staggered with respect to the passages of the other array longitudinally of the trough.

23. A metal delivery nozzle as claimed in claim 20, wherein the baffle structure comprises a baffle block fitted into the trough and the passages are formed by notches or grooves in the side faces of the block to define the passages between the block and side walls of the trough.

24. A metal delivery nozzle as claimed in claim 19, wherein said pair of flow passage means comprises a pair of elongate slot passages defined by clearance between the baffle structure and the side walls of the trough.

25. A metal delivery nozzle as claimed in claim 24, wherein each slot passage extends substantially throughout the length of the trough.

26. A metal delivery nozzle as claimed in claim 24, wherein the baffle structure is supported in the trough by support means extending from an upper part of the trough.

27. A metal delivery nozzle as claimed in claim 26, wherein the support means is formed integrally with the baffle structure and the walls of the trough.

28. A metal delivery nozzle as claimed in claim 24, wherein there is clearance between the baffle structure and the trough walls about its entire perimeter.

29. A metal delivery nozzle as claimed in claim 24, wherein the baffle structure defines an upwardly facing channel extending along the trough to receive the molten metal and to cause the molten metal to flow upwardly and outwardly of the trough on top of the baffle structure in passing to the passage means.

30. An apparatus as claimed in claim 7 further comprising a tundish disposed above said metal delivery nozzle adapted to accept molten metal therein, said tundish having a plurality of openings in the bottom thereof adapted to allow the passage of molten metal therethrough as a corresponding plurality of falling streams distributed along the length of said delivery nozzle.

* * * * *